United States Patent [19]

Anderson et al.

[11] Patent Number: 4,653,953

[45] Date of Patent: Mar. 31, 1987

[54] SUCKER ROD CONSTRUCTION

[75] Inventors: Roger A. Anderson; James L. Goodman; John D. Tickle; A. Keith Liskey, all of Bristol, Tenn.

[73] Assignee: Morrison Molded Fiber Glass Company, Bristol, Va.

[21] Appl. No.: 821,874

[22] Filed: Jan. 24, 1986

Related U.S. Application Data

[63] Continuation of Ser. No. 532,920, Sep. 16, 1983, abandoned.

[51] Int. Cl.[4] ..... F16B 11/00

[52] U.S. Cl. ..... 403/268; 403/265; 403/41

[58] Field of Search ..... 403/268, 267, 266, 265, 403/368, 41

[56] References Cited

U.S. PATENT DOCUMENTS

| | | | |
|---|---|---|---|
| 2,216,945 | 10/1920 | Hindeliter | 285/114 |
| 4,315,699 | 2/1982 | Lusk | 403/361 |
| 4,360,288 | 11/1982 | Rutledge, Jr. et al. | 403/267 |
| 4,401,396 | 8/1983 | McKay | 403/268 |
| 4,430,018 | 2/1984 | Fischer | 403/268 |
| 4,475,839 | 10/1984 | Strandberg | 403/268 |
| 4,484,833 | 11/1984 | Gallagher, Jr. | 403/343 |

FOREIGN PATENT DOCUMENTS

| | | | |
|---|---|---|---|
| 681550 | 10/1952 | United Kingdom | 403/267 |

*Primary Examiner*—Andrew V. Kundrat

*Assistant Examiner*—Joseph A. Fischetti

*Attorney, Agent, or Firm*—Lalos, Keegan & Kaye

[57] ABSTRACT

A sucker rod construction including a connector member being formed to define a rod receptacle having a closed axially inner end and an open axially outer end. The rod receptacle has a plurality of axially spaced, tapered annular surfaces. The end of a cylindrical fiberglass rod is received within said rod receptacle through the outer end and cooperates therewith to define an annular chamber between the outer surface of the end of the rod and the tapered annular surfaces. A bonding material is positioned in the annular chamber and bonds the outer surface of the end of the rod and the tapered annular surfaces. Each of the annular surfaces has an angle of taper with respect to the outer surface of the fiberglass rod, and each angle of taper is progressively less toward the open end by at least one and one-half degrees. A collet is connected to the connector member adjacent the open axially outer end of the rod receptacle and it has an axial bore therethrough retaining the end of the rod in coaxial position within the rod receptacle. A protective sleeve is disposed between the collet and the rod. The collet has an axially extending tubular portion having an outside diameter which is smaller than the outside diameter of the connector member, and a joining portion joins the outside surface of the collet and the adjoining outside surface of the connector member. The joining portion has an outer surface with a smooth curve extending between the collet and the connector member.

28 Claims, 4 Drawing Figures

SUCKER ROD CONSTRUCTION

This is a continuation of co-pending application Ser. No. 532,920 filed on Sept. 16, 1983, now abandoned.

BACKGROUND OF THE INVENTION

This invention relates to sucker rod constructions and more particularly to fiberglass sucker rods. Sucker rods are joined together to form a sucker rod string which connects a sub-surface well pump to a surface pumping unit. This string imparts a reciprocating pumping motion to the sub-surface well pump. Although the sucker rods were generally for decades constructed from steel, it is now known to construct them with a fiberglass rod portion. An example of such a fiberglass sucker rod construction is found in U.S. Pat. No. 4,360,288, the contents of which are hereby incorporated in their entirety by reference.

In the early 1970s, a solution was sought for the chemical and stress corrosion problems related to the use of steel sucker rods. It was found that, in addition to significantly reducing corrosion problems of steel sucker rods, the use of fiberglass rods resulted, in many cases, in increased production. The lighter weight of the rods cuts the pumping unit loads significantly and the reduced pumping unit load allows the pumping unit to operate faster. Also, the elasticity of the prestressed fiberglass rods string generates significant production increases due to the "overtravel." A weight is attached on the bottom of the fiberglass sucker rods, such as steel sucker rods or sinker bars, and this weight causes a higher upstroke relative to the surface stroke and a lower downstroke, that is, overtravel. This provides for a maximum overtravel whereby the pump stroke generates a greater production. The lighter fiberglass rods also allows for a longer string to be used and thus deeper wells to be dug.

Although the fiberglass sucker rods have resulted in greatly increased production and associated reduced pumping costs, premature fatigue failures has been a problem. These premature fatigue failures have occurred both in field applications and in cyclic duty tests of sample rods. It has also been experienced that the ends of the connector members would cut into the fiberglass rods thereby cutting the fibers and weakening the rod.

OBJECTS OF THE INVENTION

Accordingly, it is the principal object of the present invention to provide an improved fiberglass sucker rod construction.

Another object of the present invention is to provide an improved fiberglass sucker rod construction which is not subject to premature fatigue failures.

A further object of the present invention is to provide a novel fiberglass sucker rod construction design.

A still further object of the present invention is to provide an improved fiberglass sucker rod construction for the one-inch and the one and a quarter inch diameter fittings.

Another object of the present invention is to provide a novel construction for preventing the connector member from digging into and thereby weakening the fiberglass rods.

Other objects and advantages of the present invention will become more apparent to those persons having ordinary skill in the art to which the present invention pertains from the foregoing description taken in conjunction with the accompanying drawings.

THE DRAWINGS

DESCRIPTION OF THE PREFERRED EMBODIMENT

Figure 1:
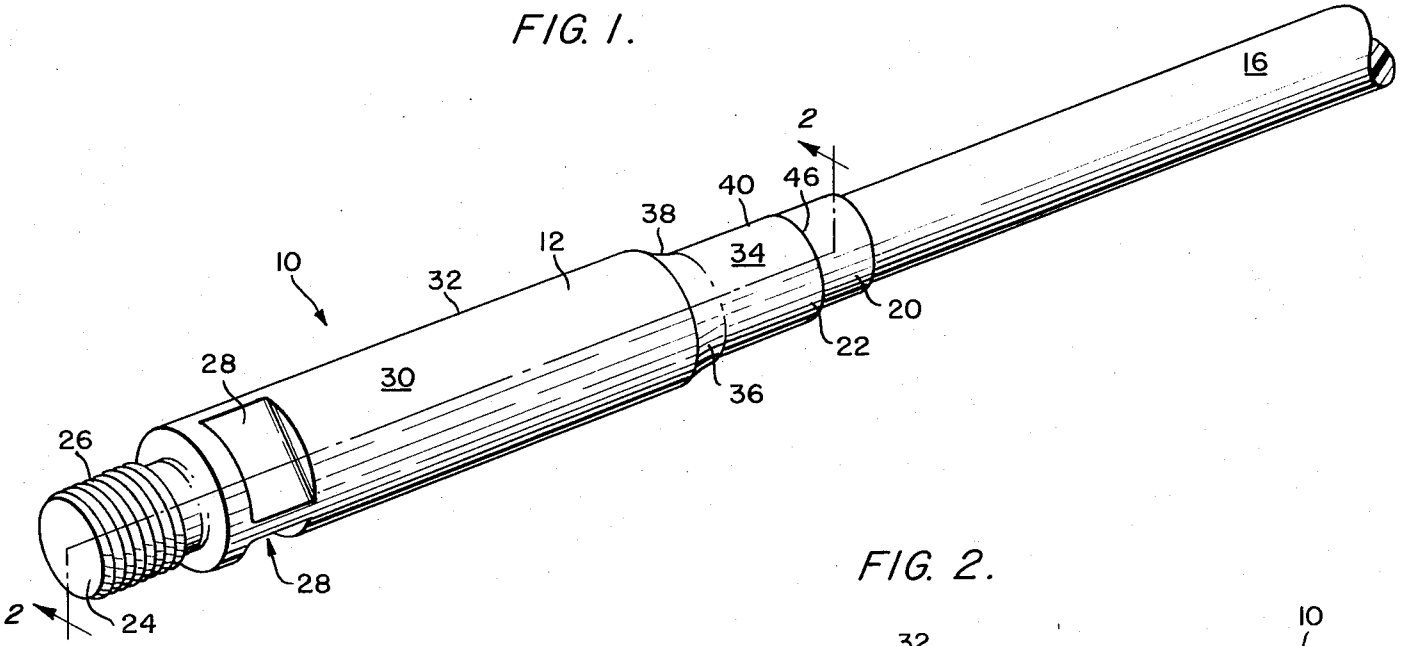
FIG. 1 is a perspective view of a sucker rod construction embodying the present invention.
Figure 2:
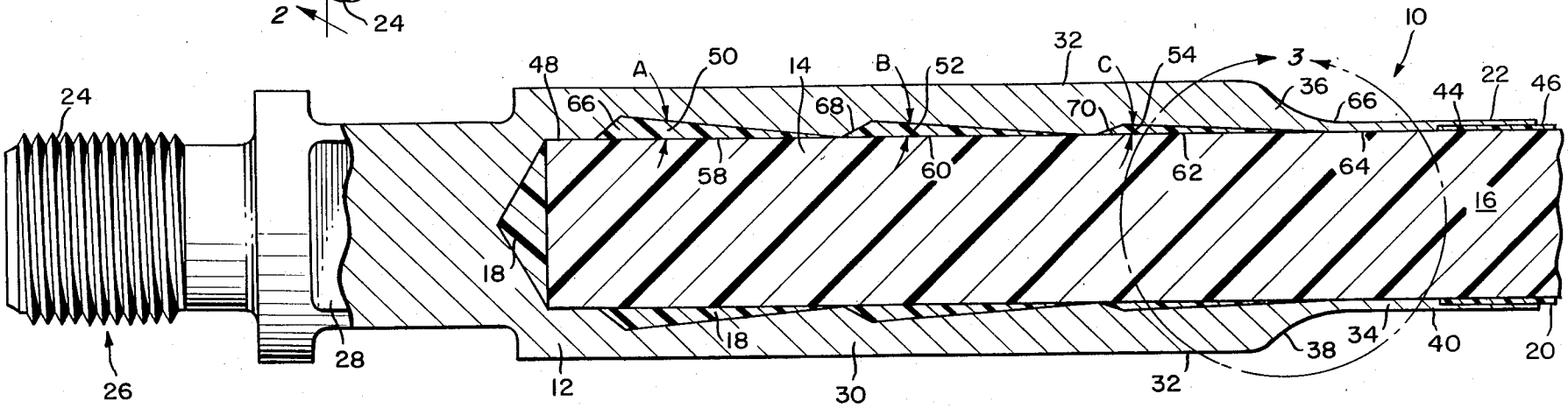
FIG. 2 is an enlarged cross-sectional view taken along line 2—2 of FIG. 1.

Referring to FIGS. 1 and 2, a sucker rod shown generally at 10 embodying the present invention is illustrated. Sucker rod 10 generally comprises four basic members: a connector member shown generally at 12 formed of a single, continuous piece of steel and having a rod receptacle 14 therein; a cylindrical fiberglass rod 16 which fits in rod receptacle 14; a body of adhesive material 18 positioned within rod receptacle 14 and between fiberglass rod 16 and connector member 12; and a plastic, cylindrical sleeve 20 positioned at the outer end 22 of connector member 12 and at least partially positioned between connector member 12 and fiberglass rod 16.

Connector member 12 at its inner end 24 has a coupling member shown generally at 26. Although shown as a male coupling, this coupling will screw into a generally identical connector member differing only in coupling member 26 being a female coupling. The fiberglass rods will then have a connector member at one end with a male coupling and one with a female coupling at the other end and will measure 37 feet 6 inches, including threaded end fittings. Generally adjacent coupling member 26 are a plurality of wrench flats 28 to which a standard sucker rod wrench is attached for coupling and uncoupling adjacent sucker rods from one another. A long cylindrical portion 30 having outside surface 32 extends from wrench flats 28 toward outer end 22. A cylindrical collet 34 having a diameter smaller than the diameter of cylindrical portion 30 forms the outer end portion of connector member 12. A joining means shown generally at 36 joins cylindrical portion 30 and collet 34 and more particularly forms an annular surface 38 joining outside surface 32 and collet outside surface 40.

Figure 3:
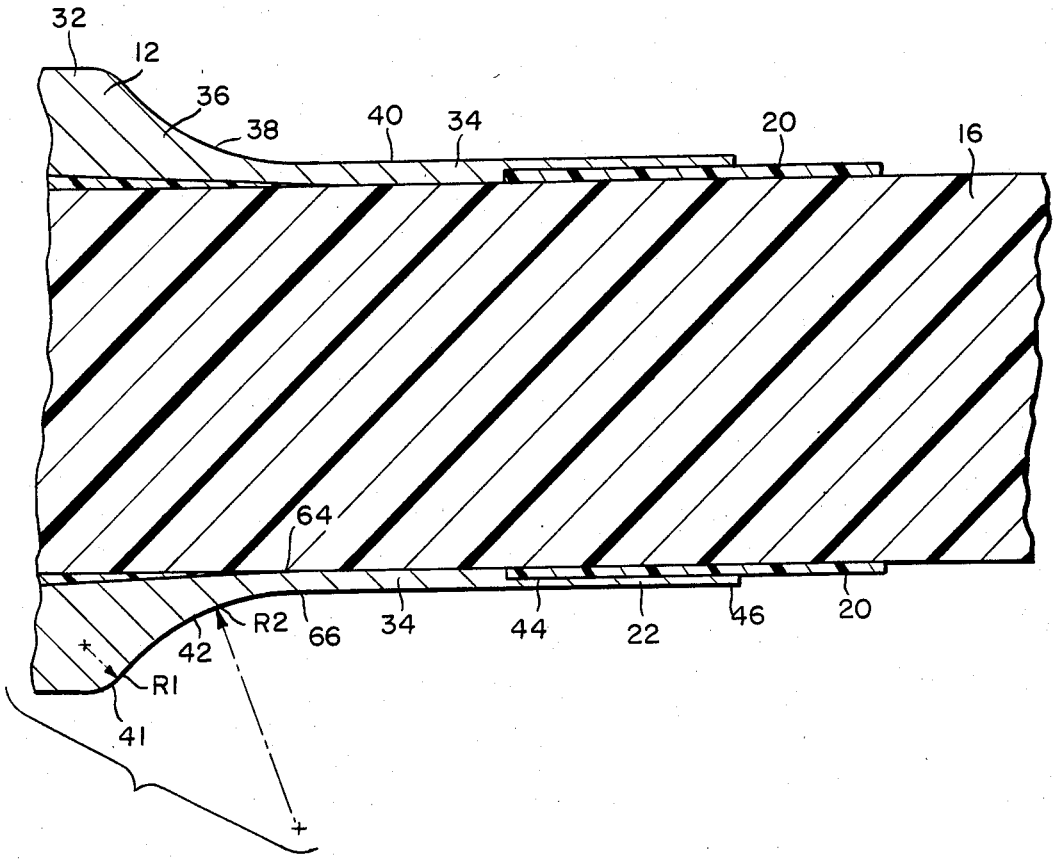
FIG. 3 is an enlarged fragmentary view of the portion of FIG. 2 illustrated by line 3.
Figure 4:
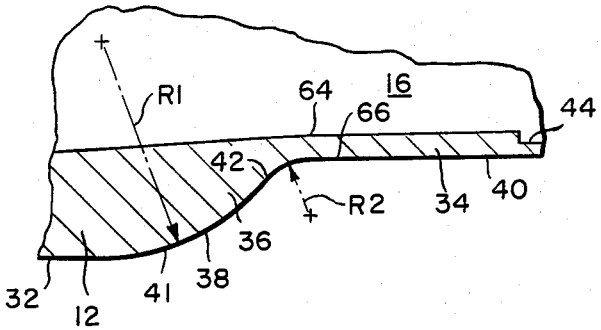
FIG. 4 is a fragmentary view similar to the lower left corner of FIG. 3 illustrating a second embodiment of the present invention.

Referring to FIGS. 3 and 4, joining means 36 and annular surface 38 are illustrated in greater detail. As shown, joining means 36 is a portion of connector member 12, in other words, cylindrical portion 30, collet 34 and joining means 36 are formed from one continuous solid piece of metal. It is further, and perhaps more importantly noted, that annular surface 38 defines a smooth curve defined by a first curve 41 with radius R1 tangent at one end to outside surface 32. At its other end it is generally tangent to oppositely curving second curve 42, and second curve 42 with radius R2 is tangent at its other end to collet outside surface 40. While the embodiment of FIG. 3 illustrates R1 being smaller than R2, it is also within the scope of the present invention, as shown in FIG. 4, for R1 to be larger than R2. The prior art "joining means" had sharp beveled edges which were subject to cracking and breaking when stressed. By contrast, the present invention eliminates this problem by providing for a novel configuration of annular surface 38 employing a smooth curve and more specifically a pair of joined and oppositely facing curves.

Rod receptacle 14 defines a unique configuration. At its outer end, as best shown in FIG. 2, collet 34 has an inner recessed, annular surface 44 which extends a short distance from the end. Annular surface 44 is provided to hold sleeve 20 between collet 34 and fiberglass rod 16. Although collet 34 is adapted to snuggly hold rod 16 in rod receptacle 14, non-axial relative movement of collet 34 and fiberglass rod 16 has in the past caused collet outer edge 46 to bite into the fiberglass and damage and weaken the rod. Sleeve 20 provides a protective material between collet outer edge 46 and the rod thereby preventing damage to the rod.

At the end of rod receptacle 14 opposite collet 34 is a bore 48, best shown in FIG. 2, fitting closely with the surface of the end of the rod and together with the collet supporting the rod in rod receptacle 14. Wrench flats 28 ideally should be even with the outer diameter of bore 48. Positioned between bore 48 and collet 34 in rod receptacle 14 are a plurality of integrally-formed, axially-spaced-apart, outwardly-converging, tapered frusto-conical annular surfaces. Although three such annular surfaces 50, 52 and 54 are illustrated in FIG. 2, it is within the scope of the present invention to provide up to seven annular surfaces. These annular surfaces, which are recessed from rod 16, provide a series of wedge shaped cavities or chambers into which adhesive material 18 is positioned. Adhesive material 18 is initially liquid when placed in the cavities and cures to bond to the outer surface of rod 14 and hardens to form a plurality of shear and compression resistant frusto-conical wedges which cooperate with the annular surfaces 50, 52 and 54 and prevent the movement of rod 16 axially out of rod receptacle 14.

Each of the wedge shapes is defined by (1) annular surfaces 50, 52 or 54, (2) rod surfaces 58, 60 or 62, respectively, each of which intersects at its outer end with its annular surface 50, 52 or 54, respectively, and (3) slanted ends 66, 68, and 70. Each slanted end terminates at the inner end of its rod surface and the inner end of its annular surface. The intersection of annular surface 50 and rod surface 58 defines taper angle A, annular surface 52 and rod surface 60 defines taper angle B, and annular surface 54 and rod surface 62 defines taper angle C. In the prior art it is known to make taper angles A, B and C equal. However, as previously discussed, these prior art sucker rods have experienced premature fatigue failures.

The present invention, therefore, provides for sucker rods having different taper angles within each rod receptacle. More particularly, the angles progressively increase from the outer to the inner end of the receptacle by at least one and one half degrees between adjacent angles and preferably two degrees. For instance, it has been found, as shown below, that surprisingly increased fatigue failure resistance is experienced when angles within the above guidelines are as follows: angle $A=6°\pm30'$, angle $B=4°\pm30'$ and angle $C=2°\pm30'$. Most significantly, the present invention is most evident when the angles are 6°, 4° and 2°, each ± about 5 minutes also as shown below. These angles have been found to "even" the stresses at each of the three rod/connector interfaces and thereby reduce the maximum equivalent stresses experienced. Thus, it is possible with the present invention to have vastly greater number of cycles before stress fatigue results.

In fact, in a test conducted by the Inventors, the following results were obtained:

| FITTING TEST | *AVG. CYCLES TO FAILURE |
|---|---|
| Controls - Fitting with 4½° tapers (All cracked) | 42,364 |
| TM-648 Fitting (2½°-4°-5½° tapers) (All cracked) | 87,750 |
| TM-648 Fitting with longer sleeve (All cracked) | 136,105 |
| TM-648 Fitting with Tuff Tubing in sleeve (All cracked) | 189,488 |
| TM-650 Fitting (2°-4°-6° tapers) (5 of 12 cracked) | 1,025,935 |

*Average cycles is to first crack except for TM-650 fitting, contains data from 7 good rods.

It is thus seen from these test results that by having the tapers progressively increased by 1½° degrees the cycle life of the sucker rod (before all of the test rods crack) increases by over 100%. Further, the use of the Inventors longer smooth curving sleeve increases the cycle life an additional 50% plus, and with the tuff tubing an additional 40%—making for a total cycle improvement of about 350% over the prior art. An example of the preferred embodiment, wherein the tapers increase progressively by 2°, was also tested. The 2°-4°-6° embodiment was chosen and after over a million cycles the test was concluded even though less than half of the test rods had cracked.

To further improve the stress fatigue life of the sucker rod, the outer end of annular surface 54 shown at 64 is positioned directly radially inward of the tangent point of second curve 42 which collet outside surface 40 shown at 65. The tolerance of the placement of outer end 64 and tangent point 65 should be within ⅛ inch.

From the foregoing detailed description, it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. A sucker rod construction comprising:

a connector member being formed to define a rod receptacle having a closed axially inner end and an open axially outer end, said rod receptacle having a plurality of axially spaced, tapered annular surfaces, a cylindrical fiberglass rod having an end having an outer surface being received within said rod receptacle through said outer end and cooperating therewith to define an annular chamber between said outer surface of said end of said rod and said tapered annular surfaces, and a bonding means positioned in said annular chamber for bonding to said outer surface of said end of said rod to confront said tapered annular surfaces, each said annular surface having an angle of taper with respect to the outer surface of said fiberglass rod, and each said angle of taper being progressively and uniformly less toward said open end by an amount between one and one-half degrees and two degrees, inclusive, a collet connected to said connector member adjacent said open axially outer end of said rod receptacle and having an axial bore therethrough retaining said end of said rod in coaxial position within said rod receptacle, said connector member having a generally cylindrical outer surface, said collet including an axially extending tubular portion having an outside diameter which is smaller than the outside diameter of said connector member, and a joining means for joining the outside surface of said collet and the adjoining outside surface of said connector member, said joining means having an outer surface having a smooth concavo-convex curvature extending between said collet and said connector member.

2. The sucker rod construction according to claim 1 including, each said angle of taper being progressively less toward said open end by two degrees.

3. The sucker rod construction according to claim 1 including, each said annular surface being the same length.

4. The sucker rod construction according to claim 3 including, said same length being $1\frac{1}{8}$ inches.

5. The sucker rod construction according to claim 1 including, said annular surfaces comprising a first annular surface adjacent said closed axially inner end, a second annular surface axially adjacent said first annular surface, and a third annular surface generally adjacent said open axially outer end and axially adjacent said second annular surface.

6. The sucker rod construction according to claim 2 including, each said angle of taper being progressively less toward said open end by $2° \pm 10'$.

7. The sucker rod construction according to claim 1 including, a sleeve disposed between said collet and said rod.

8. The sucker rod construction according to claim 7 including, a bore coaxially formed in said connector member adjacent said axially inner closed end of said rod receptacle inward of said annular surfaces, said bore being adapted to fit closely with the surface of said end of said rod, and said collet having a passage therethrough coaxial with said surface of said end of said rod whereby said bore and said collet support said end of said rod at axially spaced apart points coaxially within said rod receptacle.

9. The sucker rod construction according to claim 7 including, said sleeve comprising a cylindrically-shaped plastic material.

10. The sucker rod construction according to claim 7 including, a bore coaxially formed in said connector member adjacent said closed axially inner end of said rod receptacle inward of said annular surfaces, said bore being adapted to fit closely with the surface of said end of said rod, said collet having a passage therethrough coaxial with said surface of said end of said rod whereby said bore and said collet passage support said end of said rod at axially spaced apart points coaxially within said rod receptacle, and said sleeve being cylindrical.

11. The sucker rod construction according to claim 10 including, said sleeve comprising a plastic material.

12. The sucker rod construction according to claim 1 including, said smooth curvature comprising a first curve and an adjoining oppositely curving second curve.

13. The sucker rod construction according to claim 12 including, said first curve being tangent said outside surface of said connector member and said second curve being tangent said outside surface of said collet.

14. The sucker rod construction according to claim 13 including, said first curve having a radius greater than the radius of said second curve.

15. The sucker rod construction according to claim 13 including, said second curve having a radius greater than the radius of said first curve.

16. The sucker rod construction according to claim 13 including, said second curve being tangent to the outside surface of said collet at a point directly radially outward from the end of the outermost end of said annular surface.

17. The sucker rod construction according to claim 13 including, said second curve being tangent to said outside surface of said collet at a point directly, within $\pm 0.125$ inches, radially outward from the end of the outermost said annular surface.

18. The sucker rod construction according to claim 1 including, said collet, said connector member, and said joining means comprising a single continuous piece of metal.

19. The sucker rod construction according to claim 7 including, said collet having an end adjacent said connector member and an opposite end, and an annular portion of said collet adjacent said opposite end being recessed away from said rod and being adapted to retain said sleeve between said collet and said rod.

20. The sucker rod construction according to claim 7 including, said collet bore spacing all said bonding means from said sleeve.

21. The sucker rod construction according to claim 7 including, said sleeve comprising a plastic material.

22. The sucker rod construction according to claim 12 including, said first curve facing said fiberglass rod.

23. The sucker rod construction according to claim 1 including, said rod having a rod outermost end, said connector member adjacent said inner end and said rod outermost end defining a cavity, and adhesive material filling said cavity.

24. The sucker rod construction according to claim 23 including, said cavity being conical.

25. The sucker rod construction according to claim 1 including, each said angle of taper being progressively less toward said open end by one and one-half degrees.

26. The sucker rod construction according to claim 2 including, each said angle of taper being progressively less toward said open end by 2°±5′.

27. The sucker rod construction according to claim 5 including, said angle of taper of said first annular surface being 6°, said angle of taper of said second annular surface being 4°, and said angle of taper of said third annular surface being 2°.

28. The sucker rod construction according to claim 5 including, said angle of taper of said first annular surface being 5½°, said angle of taper of said second annular surface being 4°, and said angle of taper of said third annular surface being 2½°.

* * * * *